US010400524B1

(12) United States Patent
Cobb

(10) Patent No.: US 10,400,524 B1
(45) Date of Patent: Sep. 3, 2019

(54) SYSTEM FOR INJECTING COILED TUBING

(71) Applicant: Gregory C. Cobb, Grapevine, TX (US)

(72) Inventor: Gregory C. Cobb, Grapevine, TX (US)

( * ) Notice: Subject to any disclaimer, the term of this patent is extended or adjusted under 35 U.S.C. 154(b) by 387 days.

(21) Appl. No.: 14/855,062

(22) Filed: Sep. 15, 2015

Related U.S. Application Data

(60) Provisional application No. 62/204,342, filed on Aug. 12, 2015.

(51) Int. Cl.
*E21B 19/08* (2006.01)
*E21B 17/20* (2006.01)
*E21B 19/22* (2006.01)

(52) U.S. Cl.
CPC ..... *E21B 19/08* (2013.01); *E21B 17/20* (2013.01); *E21B 19/22* (2013.01)

(58) Field of Classification Search
CPC ..... E21B 19/08; E21B 17/20; E21B 19/22
See application file for complete search history.

(56) References Cited

U.S. PATENT DOCUMENTS 5,775,417 A * 7/1998 Council ..... B65H 51/14 166/77.3
6,173,769 B1 * 1/2001 Goode ..... E21B 19/22 166/77.3
6,276,454 B1 * 8/2001 Fontana ..... B65H 75/22 166/343
2016/0333647 A1 * 11/2016 Bjornenak ..... E21B 19/22

* cited by examiner

*Primary Examiner* — David J Bagnell
*Assistant Examiner* — Brandon M Duck
(74) *Attorney, Agent, or Firm* — Eldredge Law Firm, LLC; Richard Eldredge

(57) ABSTRACT

A coiled tubing injection and removal system includes an injector head forming a hollow cavity and configured to receive the coiled tubing therein the hollow cavity; a first chain assembly and a second chain assembly, both chain assemblies being secured within the hollow cavity and configured to engage and move the coiled tubing through the hollow cavity; and a first and second guide bar carried within the hollow cavity and configured to engage with and guide the coiled tubing in a direction relatively parallel with the first chain assembly and the second chain assembly.

7 Claims, 5 Drawing Sheets

SYSTEM FOR INJECTING COILED TUBING

BACKGROUND

1. Field of the Invention

The present invention relates generally to coiled tubing injection systems, and more specifically, to systems for injecting and extracting long lengths of coiled tubing into and out of wells.

2. Description of Related Art

Coiled tubing injection systems are well known in the art and are effective means to guide and stabilize long lengths of coiled tubing as it is injected into or extracted from wells. For example, FIG. 1 depicts a conventional coiled tubing injection system 101 wherein coiled tubing 103 is driven into a well bore (not shown) from a reel (not shown) via an injector head 105 and gooseneck assembly 107. In use, gooseneck assembly 107 feeds the coiled tubing 103 into the injector head 105, where the tubing 103 is frictionally gripped by continuously linked drive chains 109 and 111 for guidance and stability.

One of the problems commonly associated with system 101 is its limited use. For example, because drive chains 109 and 111 frictionally grip tubing 103, the length of tubing 103 that can be inserted or extracted via system 101 before the weight of tubing 103 exceeds the coefficient of friction between chains 109 and 111 is limited. Also, the weight of lengthy sections of coiled tubing 103 creates a large strain on chains 109, 111, and gooseneck 107 such that the parts often fail from excessive wear and tear.

Accordingly, although great strides have been made in the area of coiled tubing injection systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
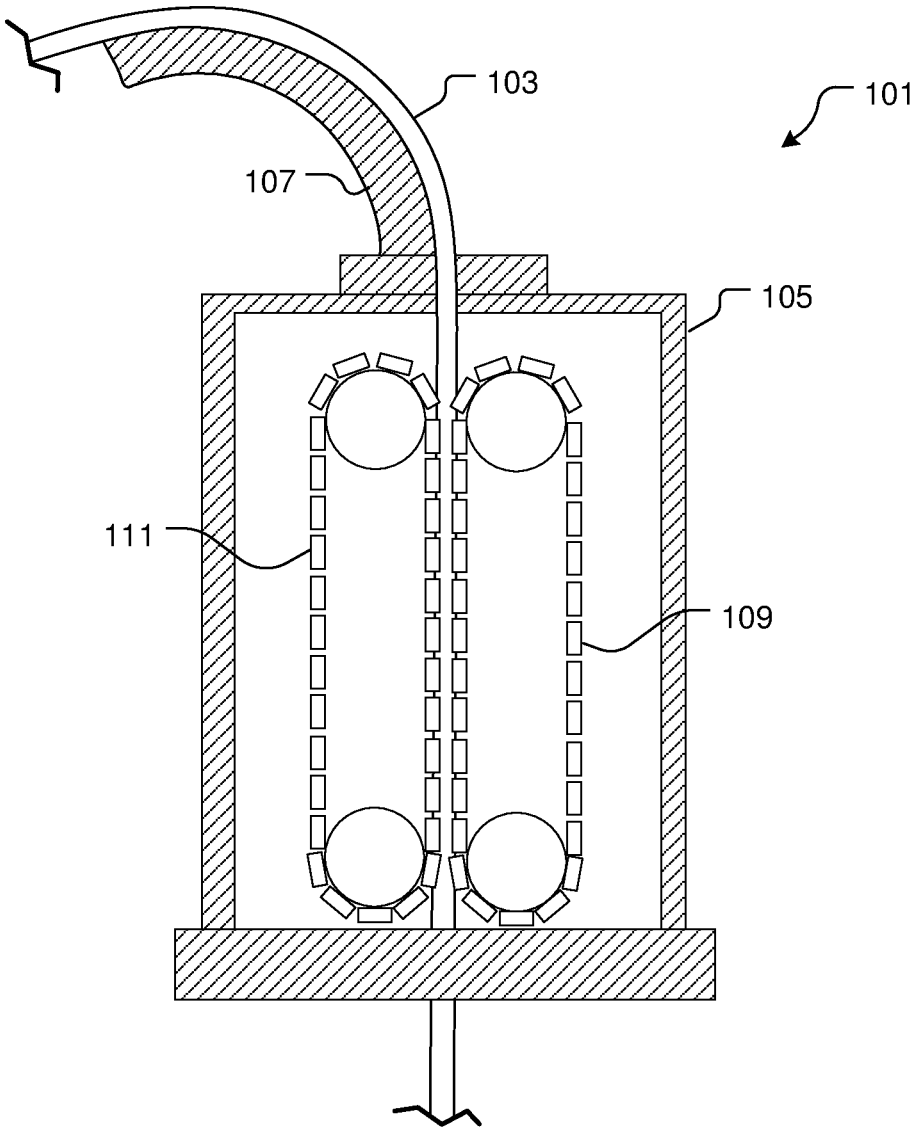
FIG. 1 (Prior Art)
FIG. 1 is a simplified, cross-sectional front view of a conventional coiled tubing injection system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional coiled tubing injection systems. Specifically, longer sections of coiled tubing can be injected into or extracted from a bore hole and with reduced wear and tear on the system and significantly lower energy costs. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
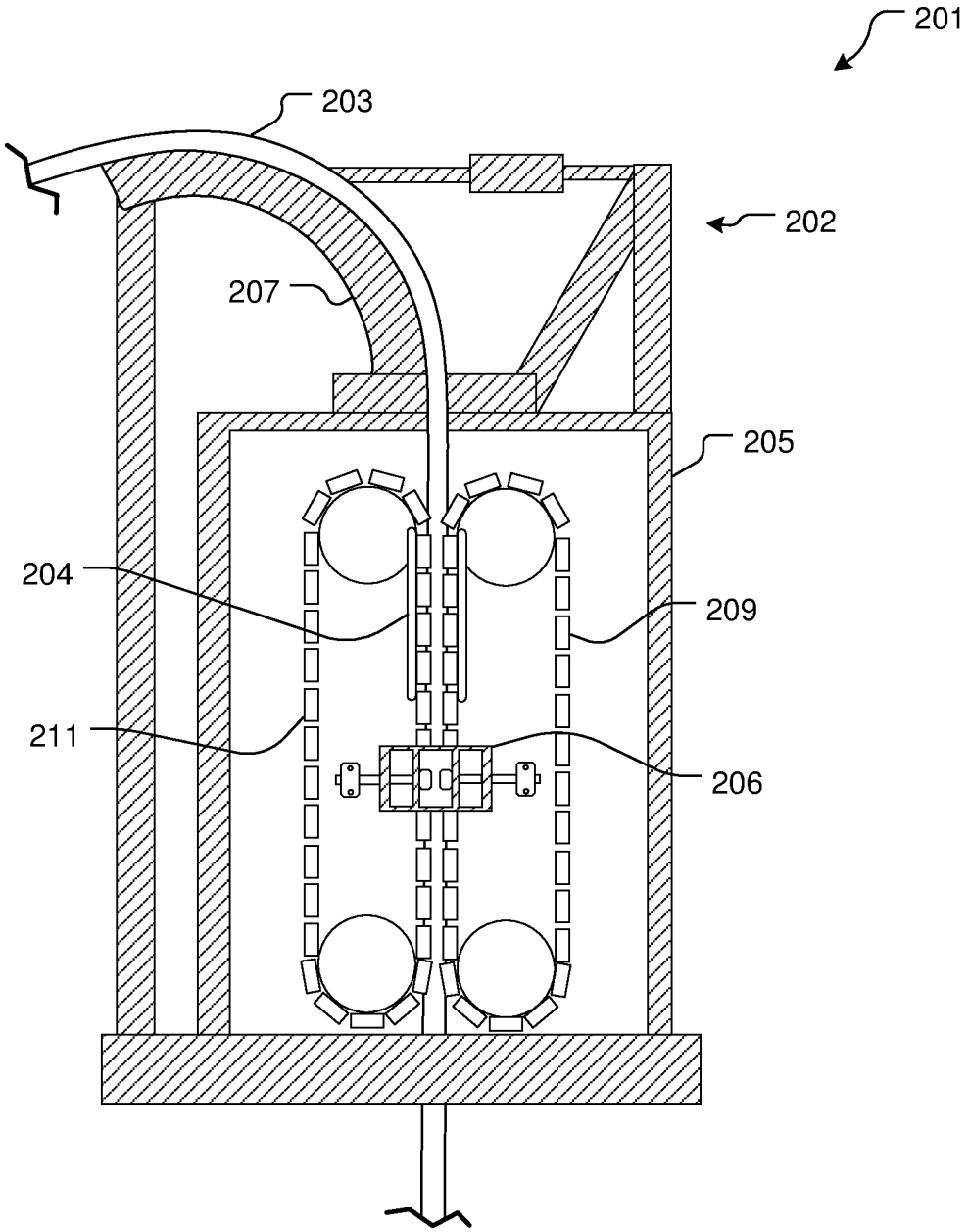
FIG. 2 is a simplified, cross-sectional front view of a coiled tubing injection system in accordance with a preferred embodiment of the present application.

Referring now to the drawings wherein like reference characters identify corresponding or similar elements throughout the several views, FIG. 2 depicts a simplified, cross-sectional front view of a coiled tubing injection system in accordance with a preferred embodiment of the present application. It will be appreciated that system 201 overcomes one of more of the above-listed problems commonly associated with conventional coiled tubing injection systems.

In the contemplated embodiment, system 201 includes a coiled tubing 203 that is driven into a well bore (not shown) from a reel (not shown) via an injector head 205 and gooseneck assembly 207, as is common for the prior art. However system 201 also incorporates a gooseneck support structure 202, one or more parabolic guide bars 204, and one or more dual piston hydraulic cylinders 206.

It should be appreciated that one of the unique features believed characteristic of the present application is that support structure 202, guide bar 204, and cylinder 206 individually and collectively minimizes wear and tear on the system. For example, it is contemplated and will be appreciated that the parabolic shape of guide bar 204 decreases knocking of chain assemblies 209 and 211 against the internal parts of the injector head 205 by catching and then guiding the chains along a vertical axis.

Another unique feature believed characteristic of the present application is that cylinder 206 enables chain assemblies 209 and 211 to more tightly grip tubing 203, thus increasing the length and weight of tubing 203 that can be supported by system 201. It is also contemplated and should be appreciated that cylinder 206 can modulate the distance between chain assemblies 209 and 211, such that different tubing sizes can be driven into or removed from the bore hole.

Figure 3A:
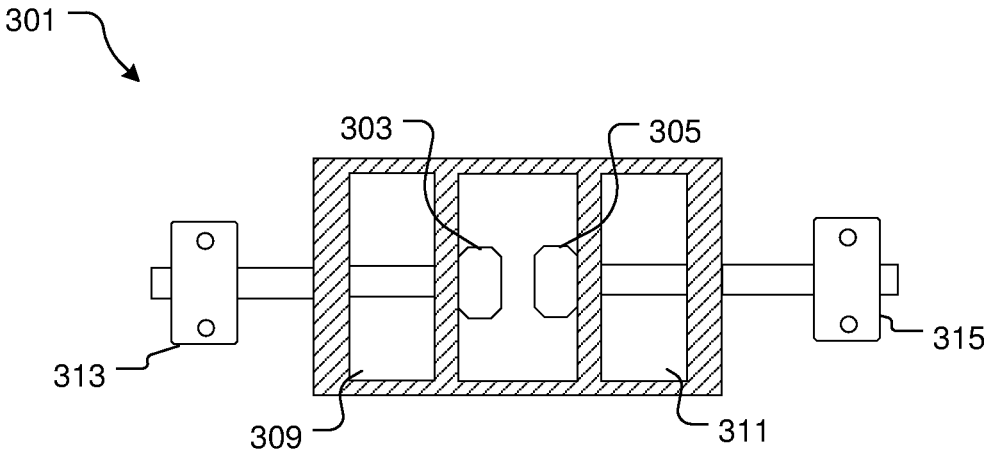
FIGS. 3A-3B show top views of the dual piston hydraulic cylinder mechanism of FIG. 2 in neutral and active states, respectively.
Figure 3B:
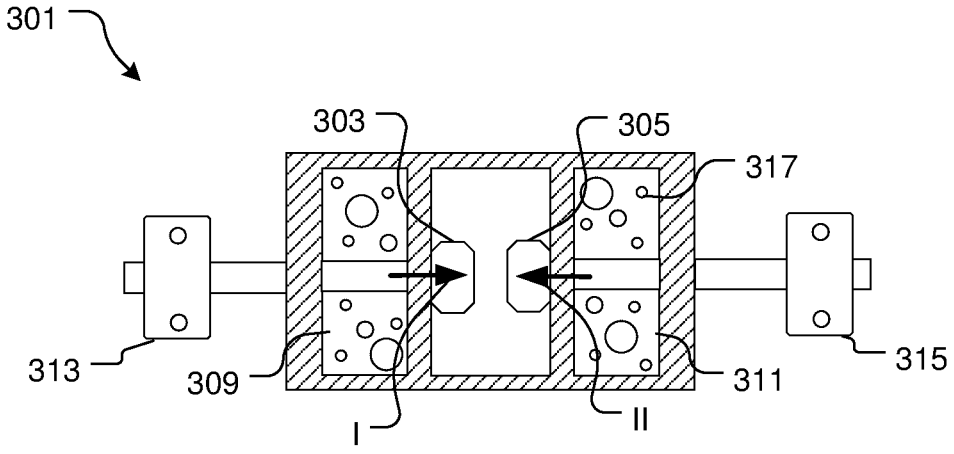

Referring now to FIGS. 3A and 3B cross-sectional top views of the dual piston hydraulic cylinder of system 201 are shown in neutral and active states, respectively. In the preferred embodiment, hydraulic cylinder 301 comprises piston heads 303 and 305 housed within a single body 307 comprising separate fluid chambers 309 and 311, respectively. It is contemplated and will be appreciated that cylinder 301 secures to the housing of chain assemblies 209 and 211 (see FIG. 2) via fasteners 313 and 315. Although fasteners 313 and 315 are shown in the preferred embodiment as bolts, alternative embodiments contemplate other fastening means such as welded plates or incorporating cylinder 301 within the housing body of chain assemblies 209 and 211 directly.

In use, hydraulic fluid 317 entering chambers 309 and 311, which in turn creates a force pushing chain assemblies 209 and 211 together (see FIG. 2) as represented by the arrows I and II of FIG. 3B. Although a dual piston hydraulic cylinder is shown, it is contemplated and will be appreciated that other means of bringing chain assemblies 209 and 211 closer together can be used, such as an electric actuator or a hydraulic ram.

Another unique feature believed characteristic of the present application is that support structure 202 significantly disperses the load on the gooseneck assembly 207.

Figure 4:
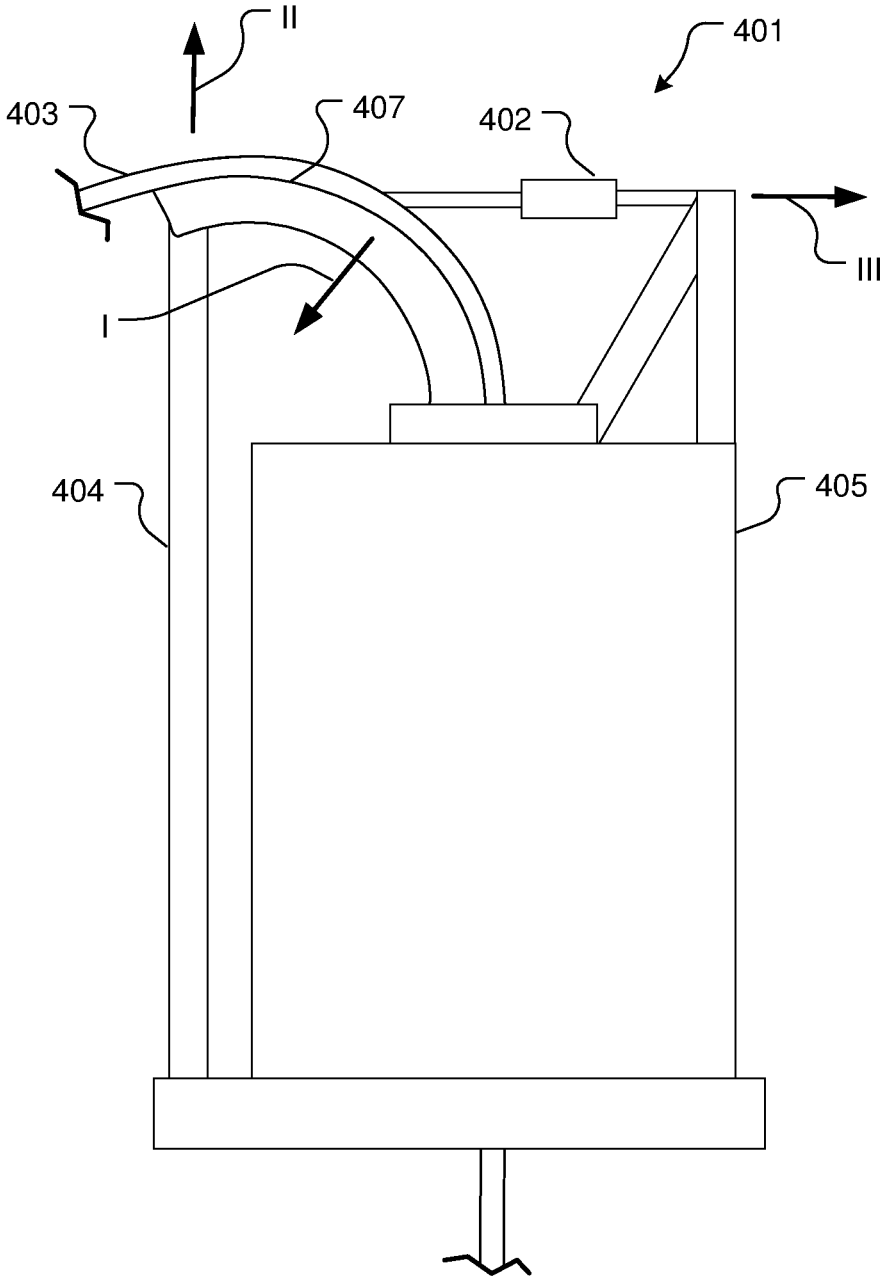
FIG. 4 is a simplified front view of the gooseneck support structure of FIG. 2.

Referring now to FIG. 4 a simplified front view of the gooseneck support structure of system 201 is shown. In the contemplated embodiment the support structure 401 comprises a pre-tensioned counter brace 402 secured to both the injector head 405 and the gooseneck assembly 407 such that a horizontal force is applied to the assembly 407. Structure 401 further comprises a vertical support brace 404 secured to both the the injector head 405 and the gooseneck assembly 407 such that a vertical force is applied to the assembly 407. It should be understood that within gooseneck assembly 407 the coiled tubing 403 will exert a force comprising both horizontal and a vertical components that are respectively counter-balanced by the horizontal and vertical forces of braces 402 and 404, as indicated by the arrows labeled I, II, and III. Although a preferred embodiment for counterbalancing force I is shown, alternative embodiments not shown contemplate counterbalancing force I via different configurations.

In the contemplated embodiment, both the horizontal and vertical braces can be adjusted via fasteners 400, 406 configured to selectively increase/decrease the overall length of the braces, which in turn changes the tension forces exerted on the gooseneck support and injector head.

Figure 5:
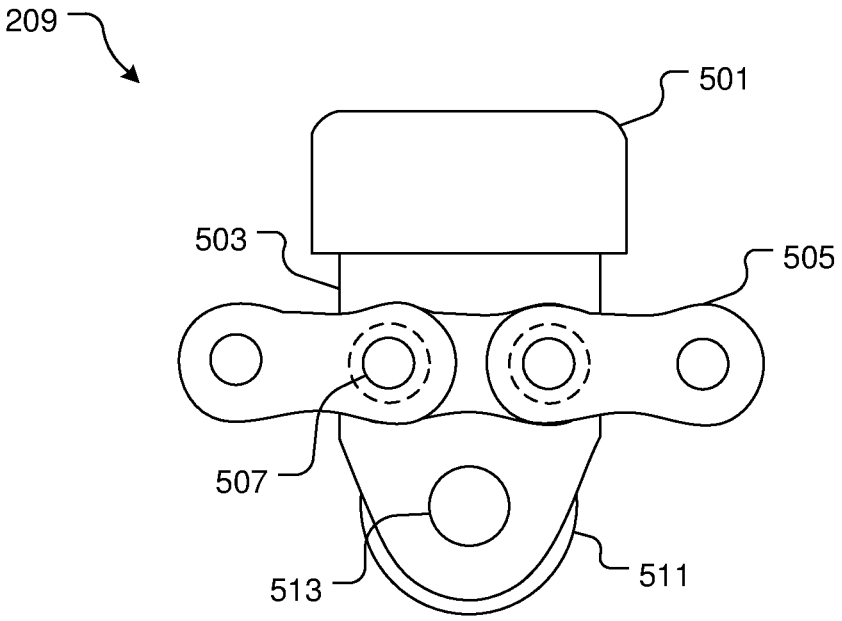
FIG. 5 is a front view of a link from the chain assembly of FIG. 2.
Figure 6:
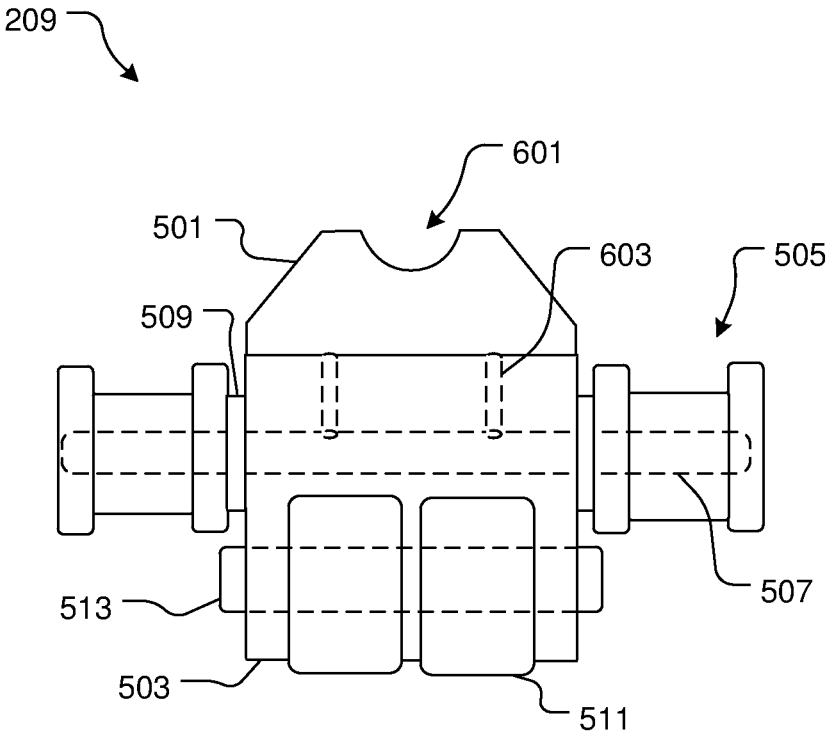
FIG. 6 is a side view of the link of FIG. 5.

Referring now to FIGS. 5 and 6, front and side views are respectively shown of an individual link from the chain assemblies 209, 211 of system 201. In the contemplated embodiment the link 500 comprises a gripping component 501 and a carrier component 503 wherein the gripping component 501 frictionally secures to the coiled tubing as it is injected or removed from a bore hole (see FIG. 2) via a conforming surface 601, and the carrier component 503 secures the link 500 to the various components of system 201 via one or more pins 507, 513, one or more rollers 511, and a roller chain 505. It is understood and will be appreciated that these features reduce the wear and tear on link 500 and system 201.

It will also be appreciated that several contemplated features of the preferred embodiment facilitate the long term maintenance of link 500 and system 201. First, each component of link 500 can be easily removed from the link for individual replacement to negate the need to replace the entire link. Second, one or more apertures 603 enable distribution of lubrication directly to internal components of the link 500 without the need for disassembly of the system. Third, one or more sealing means, such as an o-ring or toric joint, reduce the risk that internal lubrication will escape from link 500 or that abrasive materials will access the internal components of link 500. Although apertures and sealing means are shown with respect to pin 507, it is contemplated that apertures and sealing means can be implemented to lubricate and protect any moving component of link 500.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A coiled tubing injection and removal system, comprising:

an injector head forming a hollow cavity and configured to receive the coiled tubing therein the hollow cavity;

a first chain assembly and a second chain assembly, both chain assemblies being secured within the hollow cavity and configured to engage and move the coiled tubing through the hollow cavity;

a first and second guide bar carried within the hollow cavity and configured to engage with and guide the coiled tubing in a direction relatively parallel with the first chain assembly and the second chain assembly; and a dual piston cylinder secured to the injector head and disposed within the hollow cavity, the dual piston cylinder having:

a first piston and a second piston, the first piston opposing the second position and positioned in a direction perpendicular to the first chain assembly, the first piston having a first piston head configured to engage with the first chain assembly, the second piston having a second piston head configured to engage with the second chain assembly;

a gooseneck support structure configured to engage with both the injector head and a gooseneck assembly, the gooseneck support structure having:

a horizontal support adjustably secured to the injector head and the gooseneck assembly;

a horizontal fastener device secured to the horizontal support and configured to adjustably move the horizontal support along a horizontal axis;

a vertical support adjustably secured to the injector head and the gooseneck assembly;

a vertical fastener device secured to the vertical support and configured to adjustably move the vertical support along a vertical axis;

wherein the first piston and the second piston are configured to move the first chain assembly and the second chain assembly towards each other, which in turn applies pressure against the coil tubing;

wherein the first chain assembly and the second chain assembly are lubricated via an external lubrication device.

2. The system of claim 1, wherein the first guide bar and the second guide bar have elongated vertical lengths.

3. The system of claim 1, wherein the first guide bar and the second guide bar are configured to reduce knocking of the first chain assembly and the second chain assembly during use.

4. A coiled tubing injection and removal system, comprising: an injector head forming a hollow cavity and configured to receive the coiled tubing therein the hollow cavity;

a first chain assembly and a second chain assembly, both chain assemblies being secured within the hollow cavity and configured to engage and move the coiled tubing through the hollow cavity;

a gooseneck assembly secured to the injection head and configured to guide the coiled tubing from a relatively horizontal direction to a relatively vertical direction within the injection head; and a gooseneck support structure configured to engage with both the injector head and the gooseneck assembly, the gooseneck support structure having:

a horizontal support adjustably secured to the injector head and the gooseneck assembly;

a horizontal fastener device secured to the horizontal support and configured to adjustably move the horizontal support along a horizontal axis;

a vertical support adjustably secured to the injector head and the gooseneck assembly;

a vertical fastener device secured to the vertical support and configured to adjustably move the vertical support along a vertical axis;

wherein the gooseneck support structure tensions the gooseneck assembly;

wherein the first chain assembly and the second chain assembly are lubricated via an external lubrication device.

5. The system of claim 4, further comprising:

a first and second guide bar carried within the hollow cavity and configured to engage with and guide the coiled tubing in a direction relatively parallel with the first chain assembly and the second chain assembly.

6. The system of claim 5, wherein the first guide bar and the second guide bar have elongated vertical lengths.

7. The system of claim 5, wherein the first guide bar and the second guide bar are configured to reduce knocking of the first chain assembly and the second chain assembly during use.

* * * * *